US009812783B2

(12) United States Patent
Quinlan et al.

(10) Patent No.: US 9,812,783 B2
(45) Date of Patent: Nov. 7, 2017

(54) CERAMIC PATCH ANTENNA STRUCTURE

(71) Applicants: Taoglas Group Holdings Limited, Enniscorthy (IE); Antmen Technology Co., Ltd., Tainan (TW)

(72) Inventors: Ronan Quinlan, Taoyuan (TW); Tsai-Yi Yang, Taoyuan (TW)

(73) Assignees: TAOGLAS GROUP HOLDINGS LIMITED, Enniscorthy (IE); ANTMEN TECHNOLOGY CO., LTD., Tainan (TW)

( * ) Notice: Subject to any disclaimer, the term of this patent is extended or adjusted under 35 U.S.C. 154(b) by 16 days.

(21) Appl. No.: 15/057,883

(22) Filed: Mar. 1, 2016

(65) Prior Publication Data

US 2017/0256858 A1 Sep. 7, 2017

(51) Int. Cl.
*H01Q 1/38* (2006.01)
*H01Q 9/04* (2006.01)

(52) U.S. Cl.
CPC ..... *H01Q 9/0407* (2013.01); *H01Q 1/38* (2013.01)

(58) Field of Classification Search
None
See application file for complete search history.

(56) References Cited

U.S. PATENT DOCUMENTS 7,382,322 B1 * 6/2008 Yang ..... H01Q 1/243 343/700 MS
7,429,952 B2 * 9/2008 Sun ..... H01Q 9/0435 343/700 MS
2004/0189528 A1 * 9/2004 Killen ..... H01Q 9/0457 343/700 MS
2008/0039837 A1 * 2/2008 Gambale ..... A61B 17/688 606/60
2008/0231519 A1 * 9/2008 Yang ..... H01Q 1/12 343/702

(Continued)

FOREIGN PATENT DOCUMENTS

TW I277235 B 3/2007
TW 200832809 A 8/2008

(Continued)

OTHER PUBLICATIONS

Office Action dated Mar. 20, 2017 of the corresponding Taiwan patent application.

*Primary Examiner* — Trinh Dinh
(74) *Attorney, Agent, or Firm* — Chun-Ming Shih; HDLS IPR SERVICES

(57) ABSTRACT

The invention provides a ceramic patch antenna structure which comprises a composite material base body, a radiation metallic layer, a grounding metallic layer and a signal feeding element. The composite material base body is composed of a high dielectric constant (K) material and a low K material, having a front surface, a rear surface and a through hole. The radiation metallic layer is provided on the front surface of the composite material base body. The grounding metallic layer is provided on the rear surface of the composite material base body. The signal feeding element has a head thereon, the head has a shaft extending from the bottom thereof and the shaft has a projection on a surface thereof. As the signal feeding element is screwed to the through hole, the projection of the shaft destroys an internal wall of the through hole to latch in the through hole.

12 Claims, 8 Drawing Sheets

(56) References Cited

U.S. PATENT DOCUMENTS

| | | | | |
|---|---|---|---|---|
| 2010/0134357 | A1* | 6/2010 | Yang | H01Q 1/12 343/700 MS |
| 2011/0227796 | A1* | 9/2011 | Kuroda | C01G 23/00 343/700 MS |
| 2012/0146876 | A1* | 6/2012 | Yang | H01Q 1/2283 343/848 |
| 2013/0257659 | A1 | 10/2013 | Darnell et al. | |

FOREIGN PATENT DOCUMENTS

| | | | |
|---|---|---|---|
| TW | M362517 | U | 8/2009 |
| TW | 201019534 | A | 5/2010 |

* cited by examiner

CERAMIC PATCH ANTENNA STRUCTURE

BACKGROUND OF THE INVENTION

Field of the Invention

The present invention relates to a ceramic patch antenna structure, more particularly to a ceramic patch antenna structure which is manufactured by a high dielectric constant (K) material and a low K material.

Description of the Related Art

The current commercial communication antenna which is used for wireless communication products is a pin ceramic patch antenna structure. The ceramic patch antenna structure has a ceramic base body which is manufactured by ceramic materials. The ceramic base body has a radiation metallic sheet on a top surface and a grounding metallic sheet on a bottom surface. The ceramic base body, the radiation metallic sheet and the grounding metallic sheet are provided a perforation where a signal feeding body with T shape passes through to form a ceramic patch antenna structure that can be assembled on a mother board or electrically connected with a cable.

With use of a wireless communication product with the ceramic patch antenna structure, when the wireless communication product is hit by an external force or falls down the surface of the earth, the ceramic base body of the ceramic patch antenna structure is fractured easily by the external force to cause the signal feeding body with T shape running loose or departing from the ceramic base body. When the wireless communication product is used again, it may lose a function of communication or signal transmission. For example, once a drone falls down in operation to cause the fracture of the ceramic base body of the ceramic patch antenna structure, the drone may lose a function of communication or remote control when it is used next time.

SUMMARY OF THE INVENTION

It is an object of the present invention to disclose a ceramic patch antenna structure for solving the drawbacks of the traditional structure. The ceramic patch antenna structure has a base body which is manufactured by a high dielectric constant (K) material mixing with a low K material, and thus the base body becomes a composite material base body that may be not fractured easily. Also, as a signal feeding element is screwed in the composite material base body, the composite material base body can be not fractured or damaged, and combine with the signal feeding element securely.

It is another object of the present invention to disclose a ceramic patch antenna structure has a base body which is manufactured by a high K material mixing with a low K material, and thus the base body becomes light.

Accordingly, the invention provides a ceramic patch antenna structure which comprises a composite material base body, a radiation metallic layer, a grounding metallic layer and a signal feeding element. The composite material base body is composed of a high K material and a low K material, having a front surface, a rear surface and a through hole. The radiation metallic layer is provided on the front surface of the composite material base body, having a perforation corresponding to the through hole. The grounding metallic layer is provided on the rear surface of the composite material base body, having an opening corresponding to the through hole, and the opening having an internal diameter greater than the through hole thereof. The signal feeding element has a head thereon, the head has a shaft extending from the bottom thereof and the shaft has a projection on a surface thereof. As the signal feeding element is screwed to the through hole, the projection of the shaft destroys an internal wall of the through hole to latch in the through hole, the head is electrically connected with the radiation metallic layer, and an end of the shaft passes through the through hole and the opening without contacting with the grounding metallic layer.

Accordingly, the invention further provides a ceramic patch antenna structure which comprises a composite material base body, a radiation metallic layer, a grounding metallic layer and a signal feeding element. The composite material base body is composed of a high K material and a low K material, having a front surface, a rear surface and a sinking portion extending to have a through hole going through composite material base body. The signal feeding element is provided in the through hole, having a head thereon, and the head having a shaft extending from the bottom thereof, the shaft having a projection on a surface thereof. The radiation metallic layer is provided on the front surface of the composite material base body. The grounding metallic layer is provided on the rear surface of the composite material base body, having an opening corresponding to the through hole, and the opening having an internal diameter greater than the through hole thereof. As the signal feeding element is screwed to the through hole, the projection of the shaft destroys an internal wall of the through hole to latch in the through hole, the head is provided in the sinking portion and electrically connected with the radiation metallic layer on the front surface of the composite material base body, and an end of the shaft passes through the through hole and the opening without contacting with the grounding metallic layer.

In an aspect of the invention, the composite material base body comprises 30% the high K material and 70% the low K material, wherein the high K material is ceramic material, and the low K material is liquid crystal polymer. The projection is a screw, a bump or a protruding hook. The through hole has a latching portion on the surface of the internal wall thereof. The latching portion is a thread surface or a groove. Each the radiation metallic layer and the grounding metallic layer has an electroplating metallic layer thereon respectively.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
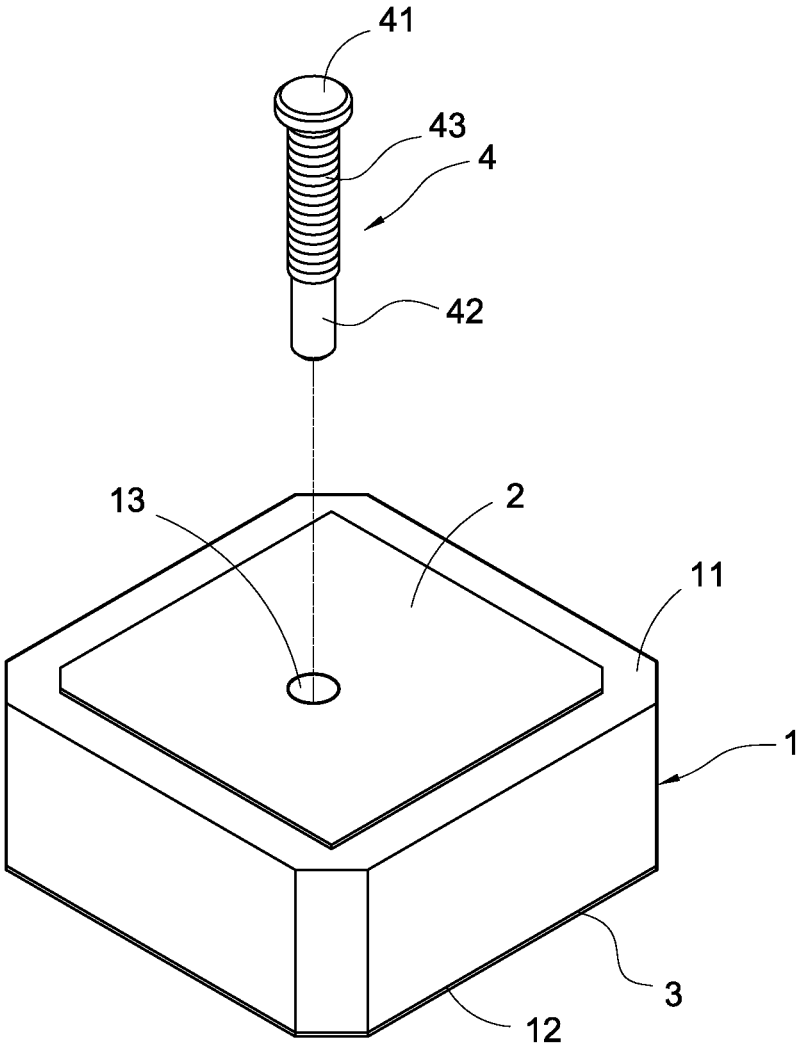
FIG. 1 shows an exploded view of a ceramic patch antenna structure of a first embodiment according to the present invention.
Figure 2:
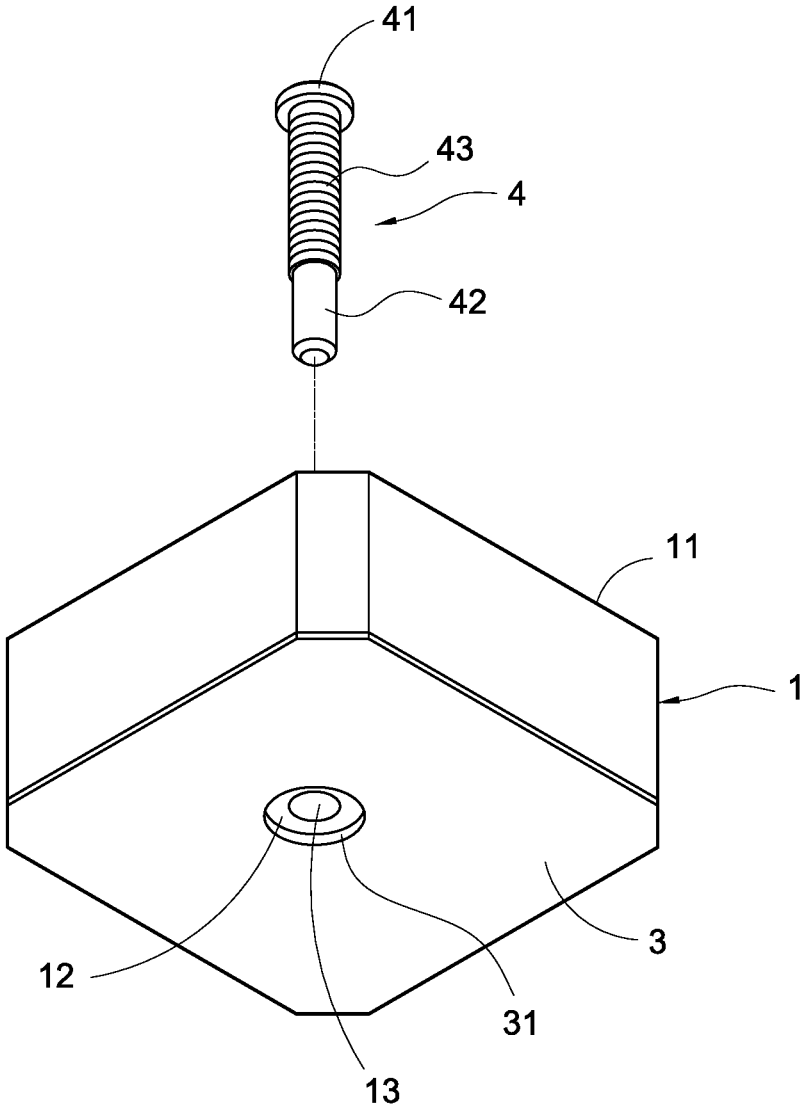
FIG. 2 shows another exploded view of a ceramic patch antenna structure of a first embodiment according to the present invention.
Figure 3:
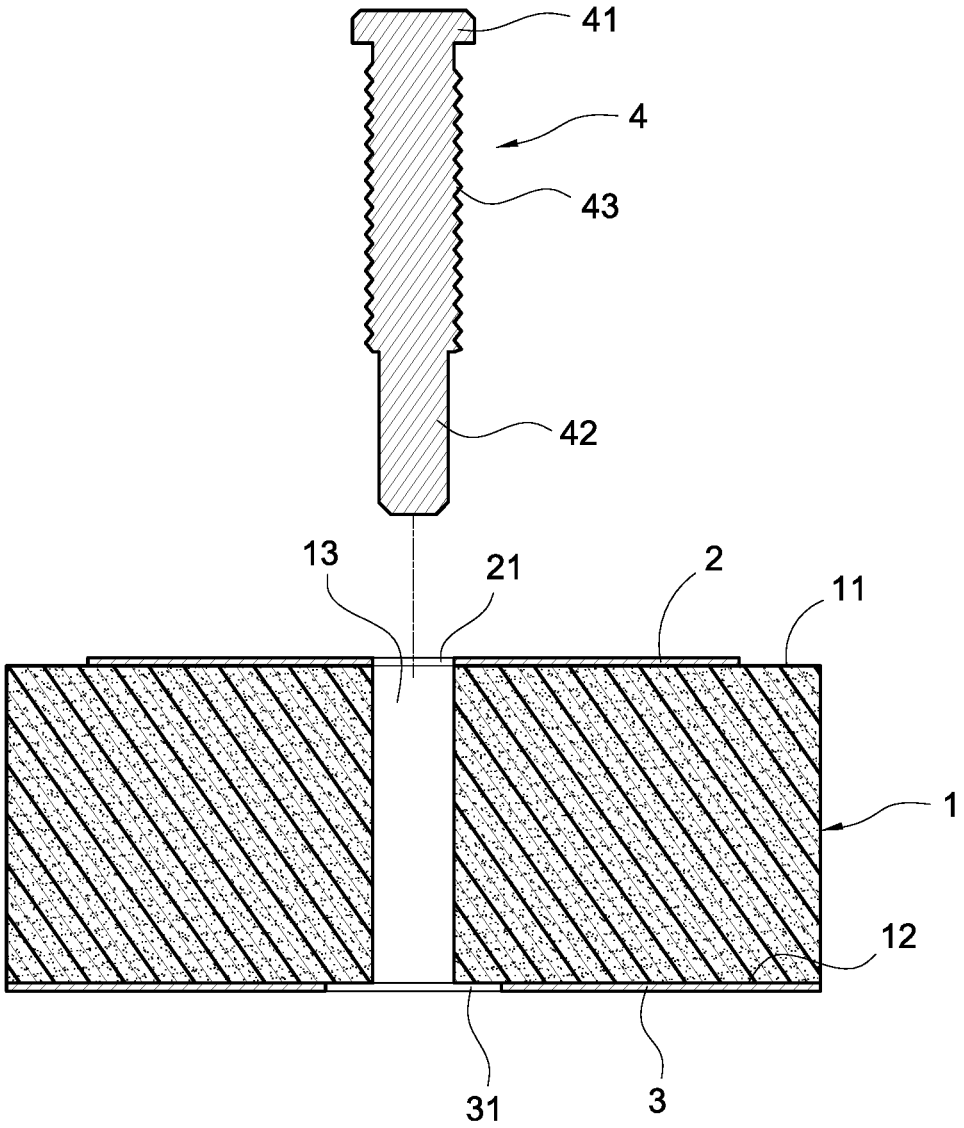
FIG. 3 shows a side view of a ceramic patch antenna structure of a first embodiment according to the present invention.

FIG. 1 shows an exploded view of a ceramic patch antenna structure of a first embodiment according to the present invention. FIG. 2 shows another exploded view of a ceramic patch antenna structure of a first embodiment according to the present invention. FIG. 3 shows a side view of a ceramic patch antenna structure of a first embodiment according to the present invention. According to FIGS. 1 and 2, the invention provides a ceramic patch antenna structure which comprises a composite material base body 1, a radiation metallic layer 2, a grounding metallic layer 3 and a signal feeding element 4.

The composite material base body 1 includes a high dielectric constant (K) material and a low K material, and forms a block. The composite material base body 1 has a front surface 11 and a rear surface 12, and has a through hole 13 for embedding the signal feeding element 4 in. In FIG. 1, the high K material is 30% ceramic material, and the low K material is 70% liquid crystal polymer (LCP).

The radiation metallic layer 2 is provided on the front surface 11 of the composite material base body 1. In FIG. 3, the radiation metallic layer 2 has a perforation 21 corresponding to the through hole 13, and through the perforation 21 where the signal feeding element 4 passes to enter the through hole 13. The radiation metallic layer 2 is made of copper.

The grounding metallic layer 3 is provided on the rear surface 12 of the composite material base body 1. The grounding metallic layer 3 has an opening 31 corresponding to the through hole 13, and the opening 31 has an internal diameter greater than the through hole 13 thereof so that the signal feeding element 4 can pass the opening 31 without contacting with the grounding metallic layer 3. The grounding metallic layer 3 is made of copper.

The signal feeding element 4 has a head 41 thereon, and the head 41 has a shaft 42 extending from the bottom thereof. The shaft 42 has a projection 43 on a surface thereof. The projection 43 may be a screw, a bump or a protruding hook.

In manufacturing the ceramic patch antenna structure, the radiation metallic layer 2 and the grounding metallic layer 3 are firstly formed on the front surface 11 and the rear surface 12 of the composite material base body 1 respectively. Next, the signal feeding element 4 is screwed to the through hole 13 through the perforation 21 by the shaft 42, and the projection 43 of the shaft 42 may destroy an internal wall of the through hole 13 to form a latching state by screwing the projection 43 inside the composite material base body 1, and thus the signal feeding element 4 is latched securely in the through hole 13. As the signal feeding element 4 is latched in the through hole 13, the head 41 of the signal feeding element 4 is electrically connected with the radiation metallic layer 2, and after the shaft 42 passes through the through hole 13 and the opening 31, an end of the shaft 42 may not electrically connect with the grounding metallic layer 3 but may be provided to electrically connect with a signal feeding wire (not shown) or a circuit board (not shown) as used.

Figure 4:
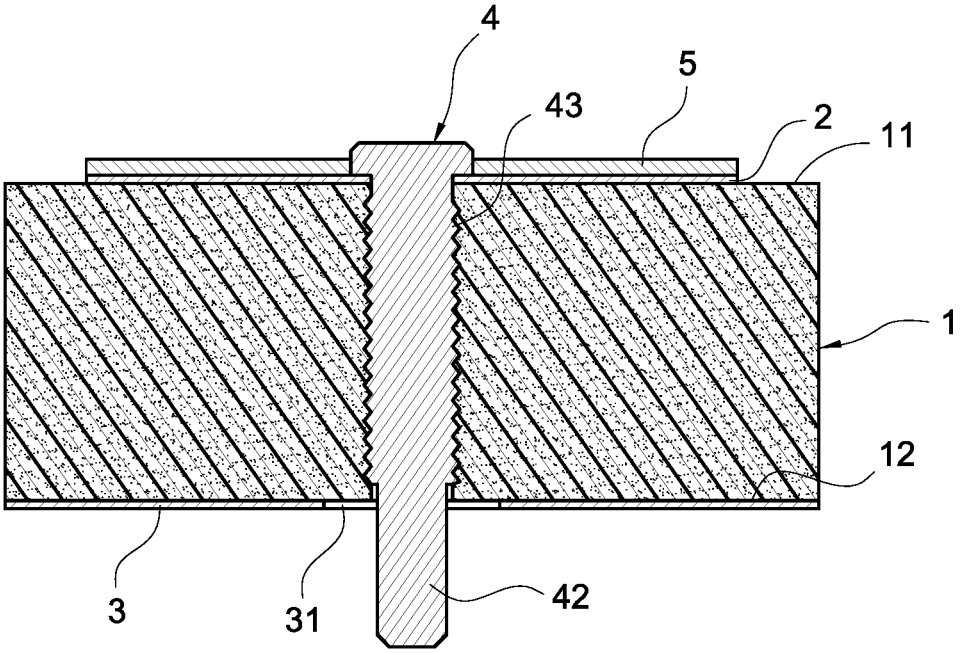
FIG. 4 shows a side view of a ceramic patch antenna structure of a second embodiment according to the present invention.

FIG. 4 shows a side view of a ceramic patch antenna structure of a second embodiment according to the present invention. According to FIG. 4, after the signal feeding element 4 of the first embodiment of the invention is screwed inside the composite material base body 1, an electroplating metallic layer 5 is provided on the radiation metallic layer 2 and the grounding metallic layer 3 with metallic materials such as copper by an electroplating technique. The electroplating metallic layer 5 is not only used to electrically connect the head 41 of the signal feeding element 4 with the radiation metallic layer 2 but also to enhance the signal emitting and receiving properties of the ceramic patch antenna structure.

Figure 5:
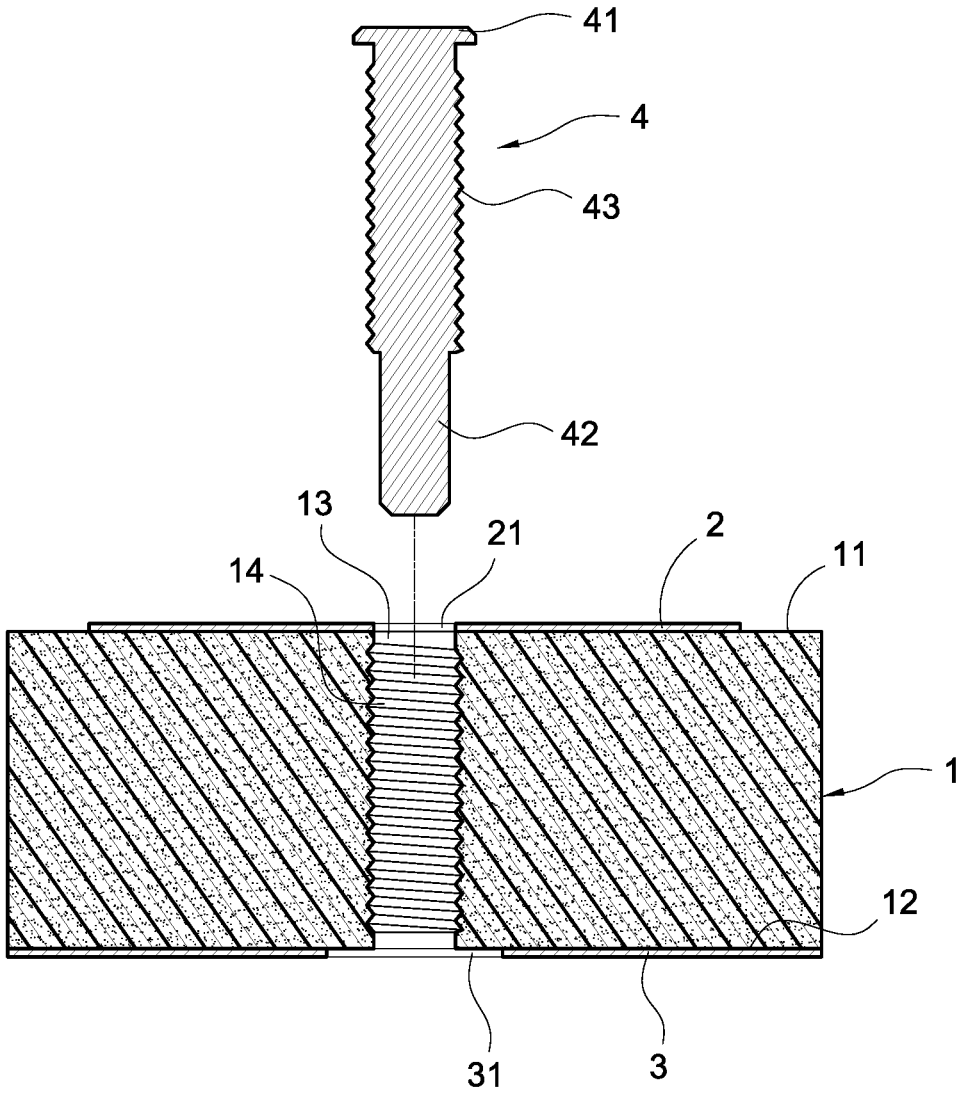
FIG. 5 shows a side view of a ceramic patch antenna structure of a third embodiment according to the present invention.

FIG. 5 shows a side view of a ceramic patch antenna structure of a third embodiment according to the present invention. According to FIG. 5, the third embodiment is similar to the first and second embodiments, and the difference with the first and second embodiments is that the third embodiment has a latching portion 14 provided in the surface of the internal wall of the through hole 13 of the composite material base body 1. The latching portion 14 may be a thread surface or a groove fitted to a shape of the projection 43. For example, in case that the projection 43 is a screw and the latching portion 14 is a thread surface in the through hole 13, as the projection 43 is screwed in the through hole 13, the projection 43 can be latched with the latching portion 14. Alternatively, in case that the projection 43 is a bump or a protruding hook and the latching portion 14 is a groove, as the projection 43 is screwed in the through hole 13, the bump or the protruding hook can be latched with the groove. Therefore, the signal feeding element 4 can be latched securely in the through hole 13.

Figure 6:
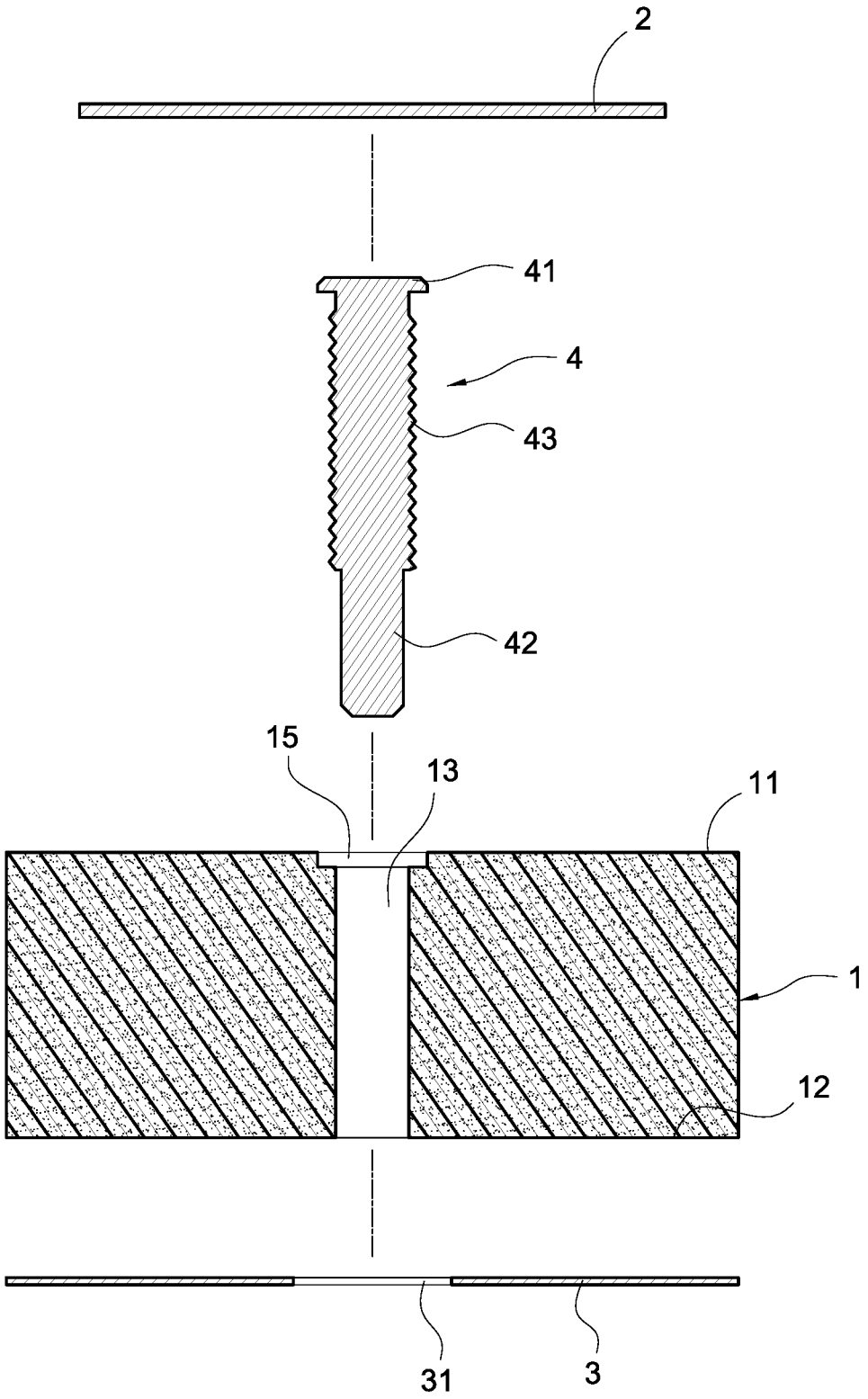
FIG. 6 shows an exploded side view of a ceramic patch antenna structure of a fourth embodiment according to the present invention.
Figure 7:
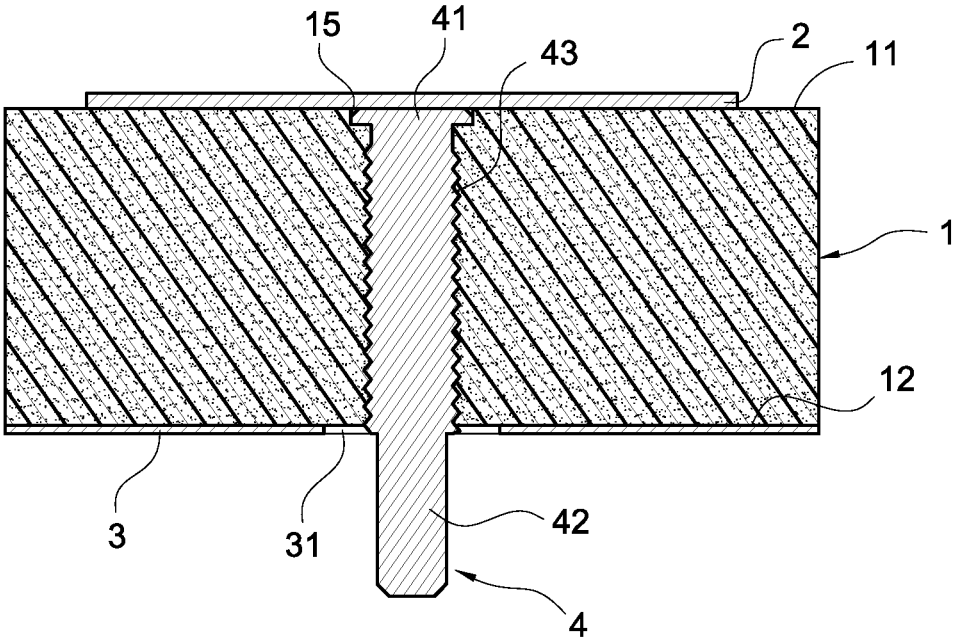
FIG. 7 shows an assembled side view of a ceramic patch antenna structure of a fourth embodiment according to the present invention.

FIG. 6 shows an exploded side view of a ceramic patch antenna structure of a fourth embodiment according to the present invention. FIG. 7 shows an assembled side view of a ceramic patch antenna structure of a fourth embodiment according to the present invention. According to FIGS. 6 and 7, the fourth embodiment is similar to the first embodiment, and the difference with the first embodiment is that the fourth embodiment has a sinking portion 15 on the through hole 13 of the front surface 11 of the composite material base body 1. As the signal feeding element 4 is screwed to the through hole 13, the projection 43 of the shaft 42 may destroy an internal wall of the through hole 13 to form a latching state by screwing the projection 43 inside the composite material base body 1, and thus the signal feeding element 4 is latched securely in the through hole 13 and the head 41 of the signal feeding element 4 is provided in the sinking portion 15.

After the signal feeding element 4 is screwed to the through hole 13 of the composite material base body 1, a radiation metallic layer 2 and the grounding metallic layer 3 are formed on the front surface 11 and the rear surface 12 of the composite material base body 1 respectively. After the radiation metallic layer 2 is formed, the head 41 of the signal feeding element 4 is hidden between the radiation metallic layer 2 and the composite material base body 1.

Figure 8:
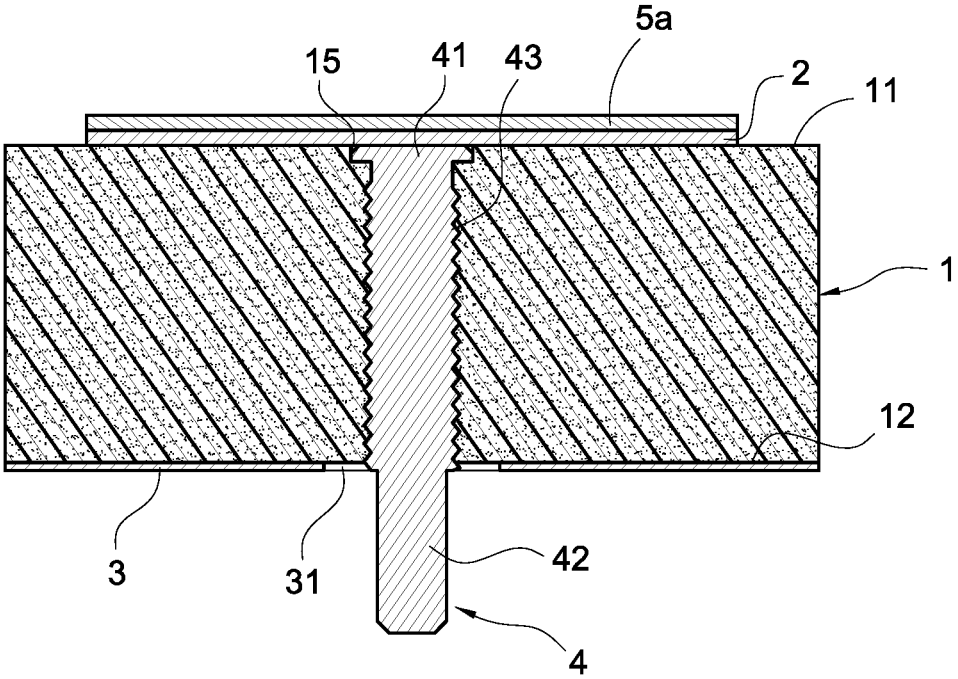
FIG. 8 shows a side view of a ceramic patch antenna structure of a fifth embodiment according to the present invention.

FIG. 8 shows a side view of a ceramic patch antenna structure of a fifth embodiment according to the present invention. According to FIG. 8, the fifth embodiment is similar to the fourth embodiment, and the difference with the fourth embodiment is that after the signal feeding element 4 of the fourth embodiment of the invention is screwed inside the composite material base body 1, an electroplating metallic layer 5*a* is provided on the radiation metallic layer 2 and the grounding metallic layer 3 with metallic materials such as copper by an electroplating technique. The electroplating metallic layer 5*a* is not only used to electrically connect the head 41 of the signal feeding element 4 with the radiation metallic layer 2 but also to enhance the signal emitting and receiving properties of the ceramic patch antenna structure.

Figure 9:
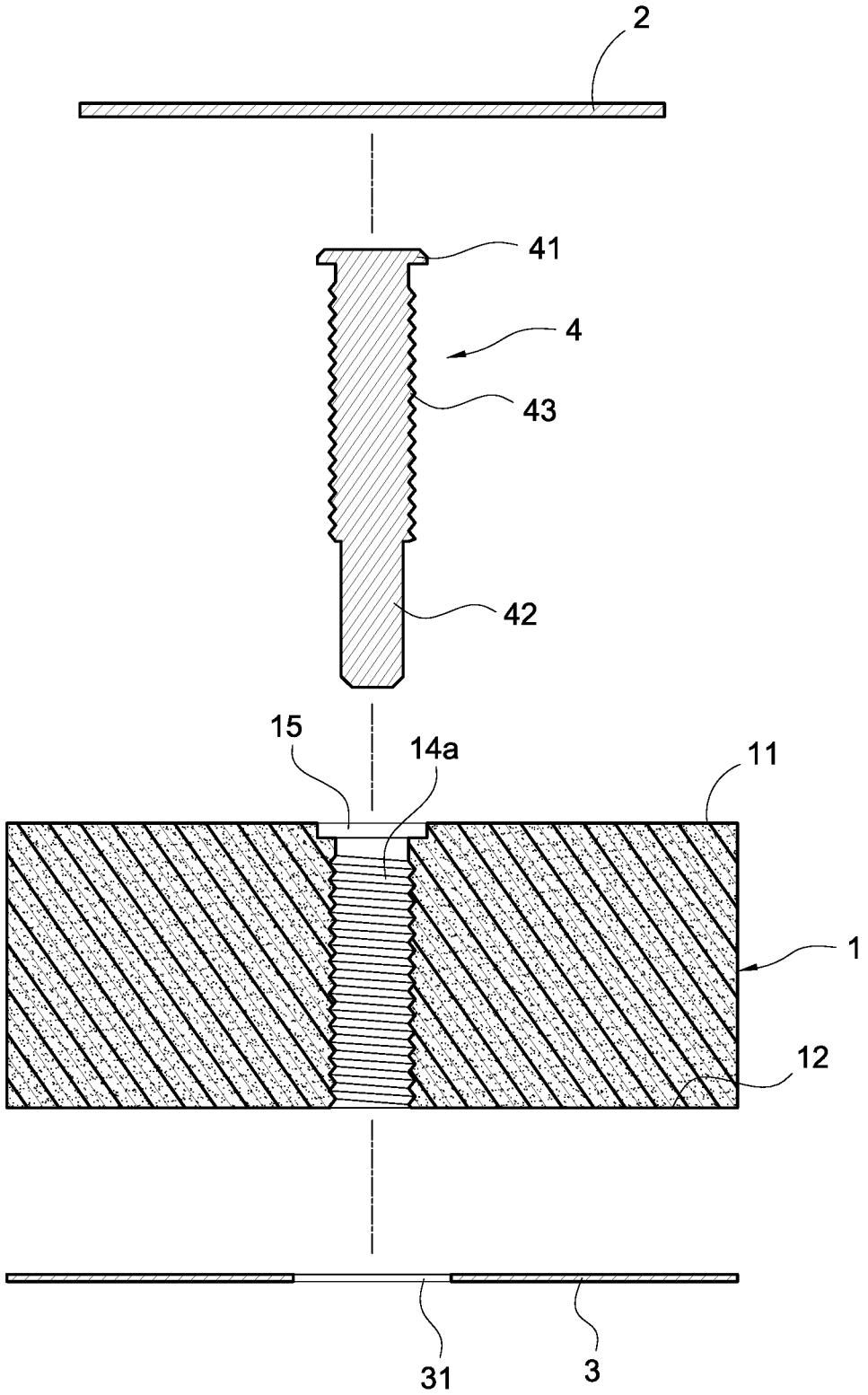
FIG. 9 shows a side view of a ceramic patch antenna structure of a sixth embodiment according to the present invention.

FIG. 9 shows a side view of a ceramic patch antenna structure of a sixth embodiment according to the present invention. According to FIG. 9, the sixth embodiment is similar to the fourth and fifth embodiments, and the difference with the fourth and fifth embodiments is that the sixth embodiment has a latching portion 14*a* provided in the surface of the internal wall of the through hole 13 of the composite material base body 1. For example, in case that the projection 43 is a screw and the latching portion 14*a* is a thread surface in the through hole 13, as the projection 43 is screwed in the through hole 13, the projection 43 can be latched with the latching portion 14*a*. Therefore, the signal feeding element 4 can be latched securely in the through hole 13 of the composite material base body 1.

The invention is not limited to these embodiments, but various variations and modifications may be made without departing from the scope of the invention.

What is claimed is:

1. A ceramic patch antenna structure, comprising:

a composite material base body, composed of a first dielectric constant material and a second dielectric constant material, having a front surface, a rear surface and a through hole, wherein a dielectric constant of the first dielectric constant material is higher than a dielectric constant of the second dielectric constant material;

a radiation metallic layer, provided on the front surface of the composite material base body, having a perforation corresponding to the through hole;

a grounding metallic layer, provided on the rear surface of the composite material base body, having an opening corresponding to the through hole, and the opening having an internal diameter greater than an internal diameter of the through hole; and a signal feeding element, provided in the through hole, the signal feeding element having a shaft with a projection formed thereon, two distal ends of the shaft extending to form a head and an end portion, respectively;

wherein the signal feeding element is screwed to the through hole, the projection on the shaft destroys an internal wall of the through hole to latch in the through hole, the head is electrically connected with the radiation metallic layer, and the end portion passes through the through hole and the opening without contacting with the grounding metallic layer;

wherein a diameter of the shaft is larger than a diameter of the end portion; and wherein a latching portion is formed on a surface of the internal wall of the through hole, and the latching portion is a thread surface or a groove.

2. The ceramic patch antenna structure according to claim 1, wherein the composite material base body comprises 30% the first dielectric constant material and 70% the second dielectric constant material.

3. The ceramic patch antenna structure according to claim 2, wherein the first dielectric constant material is ceramic material.

4. The ceramic patch antenna structure according to claim 3, wherein the second dielectric constant material is liquid crystal polymer.

5. The ceramic patch antenna structure according to claim 2, wherein the projection is a screw, a bump or a protruding hook.

6. The ceramic patch antenna structure according to claim 2, wherein each the radiation metallic layer and the grounding metallic layer has an electroplating metallic layer thereon.

7. A ceramic patch antenna structure, comprising:

a composite material base body, composed of a first dielectric constant material and a second dielectric constant material, having a front surface, a rear surface and a sinking portion extending to have a through hole going through composite material base body, wherein a dielectric constant of the first dielectric constant material is higher than a dielectric constant of the second dielectric constant material;

a signal feeding element, provided in the through hole, the signal feeding element having a shaft with a projection formed thereon, two distal ends of the shaft extending to form a head and an end portion, respectively;

a radiation metallic layer, provided on the front surface of the composite material base body; and a grounding metallic layer, provided on the rear surface of the composite material base body, having an opening corresponding to the through hole, and the opening having an internal diameter greater than an internal diameter of the through hole, wherein the signal feeding element is screwed to the through hole, the projection on the shaft destroys an internal wall of the through hole to latch in the through hole, the head is provided in the sinking portion and electrically connected with the radiation metallic layer on the front surface of the composite material base body, and the end portion passes through the through hole and the opening without contacting with the grounding metallic layer;

wherein a diameter of the shaft is larger than a diameter of the end portion; and wherein a latching portion is formed on a surface of the internal wall of the through hole, and the latching portion is a thread surface or a groove.

8. The ceramic patch antenna structure according to claim 7, wherein the composite material base body comprises 30% the first dielectric constant material and 70% the second dielectric constant material.

9. The ceramic patch antenna structure according to claim 8, wherein the first dielectric constant material is ceramic material.

10. The ceramic patch antenna structure according to claim 9, wherein the second dielectric constant material is liquid crystal polymer.

11. The ceramic patch antenna structure according to claim 8, wherein the projection is a screw, a bump or a protruding hook.

12. The ceramic patch antenna structure according to claim 8, wherein each the radiation metallic layer and the grounding metallic layer has an electroplating metallic layer thereon.

* * * * *